US006925272B2

(12) United States Patent
Higuchi

(10) Patent No.: US 6,925,272 B2
(45) Date of Patent: Aug. 2, 2005

(54) METHOD AND APPARATUS FOR FORMING TWO MULTI-COLORED PRINT IMAGES

(75) Inventor: Tetsuya Higuchi, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/667,338

(22) Filed: Sep. 23, 2003

(65) Prior Publication Data

US 2004/0062561 A1 Apr. 1, 2004

(30) Foreign Application Priority Data

Sep. 30, 2002 (JP) ..... 2002-285304

(51) Int. Cl.[7] ..... G03G 15/00
(52) U.S. Cl. ..... 399/82
(58) Field of Search ..... 399/82

(56) References Cited

FOREIGN PATENT DOCUMENTS

JP A 11-115249 4/1999

JP A 2000-305744 11/2000

OTHER PUBLICATIONS

Cited reference JP 11–115249—computer translation.*

* cited by examiner

*Primary Examiner*—Quana M. Grainger
(74) *Attorney, Agent, or Firm*—Oliff & Berridge, PLC

(57) ABSTRACT

An image forming apparatus includes a simultaneous printing unit configured to transfer a mono-color developer image for two pages onto an intermediate transfer body successively to form a multi-color developer image for two pages onto two sheets of recording media, thereby to form two multi-color images including first and second multi-color images. The simultaneous printing unit generates image data of each color for simultaneous printing so that a variety of colors of image data for forming the first multi-color image coincide with a variety of colors of image data for forming the second multi-color image, when a variety of colors of developers required for forming the first multi-color image are different from a variety of colors of developers required for forming the second multi-color image.

9 Claims, 5 Drawing Sheets

METHOD AND APPARATUS FOR FORMING TWO MULTI-COLORED PRINT IMAGES

BACKGROUND OF THE INVENTION

1. Field of the Invention

The present invention relates to an image forming apparatus such a color laser printer and an image forming method.

2. Background Art

As a color laser printer, there is known a so-called four-cycle type color laser printer including four developing rollers provided according to the colors of cyan, magenta, yellow and black, a photosensitive body for forming electrostatic latent images developed by the developing rollers, an intermediate transfer body disposed opposite to the photosensitive body, and a transfer roller disposed opposite to the intermediate transfer body.

In the four-cycle type color laser printer, electrostatic latent images formed successively on the photosensitive body are developed successively by mono-color toners provided from the developing rollers provided according to the colors. In this manner, mono-color toner images are formed successively on the photosensitive body. The mono-color toner images are transferred successively onto the intermediate transfer body so as to be superposed on one another. In this manner, a multi-color toner image is formed on the intermediate transfer body. The multi-color toner image is transferred onto a sheet of paper by the transfer roller. Thus, a multi-color image is formed on the sheet of paper.

As the four-cycle type color laser printer, there is known a printer capable of performing simultaneous printing as follows. When, for example, the circumferential lengths of the photosensitive body and the intermediate transfer body are selected so that printing can be made on an A3-size sheet of paper, each of the photosensitive body and the intermediate transfer body are divided into two. Two A4-size pages' mono-color toner images are carried simultaneously on the photosensitive body and transferred successively onto the intermediate transfer body so as to be superposed on one another. As a result, two A4-size pages' multi-color toner images are carried simultaneously on the intermediate transfer body. The two A4-size pages' multi-color toner images are transferred continuously onto two A4-size sheets of paper by the transfer roller. Thus, simultaneous printing is completed.

Because of hardware characteristic of the color laser printer, such simultaneous printing, however, can be performed only in the condition that a variety of colors used for printing on the first sheet of paper are the same as a variety of colors used for printing on the second sheet of paper. That is, such simultaneous printing cannot be performed in the condition that a variety of colors used for printing on the first sheet of paper are different from a variety of colors used for printing on the second sheet of paper.

Therefore, for example, JP-A-11-115249 has proposed a printer having a multi-page simultaneous printing function such as a twin printing function for performing simultaneous printing on two monochrome or color pages.

In the process described in JP-A-11-115249, however, pages of a document to be printed are grouped into monochrome blocks and color blocks successively from the first page. Accordingly, unless the step of grouping all pages (up to the final page) into blocks is completed in one printing job, printing on the first page cannot be started. This is insufficient to attain shortening of the printing process.

In the process described in JP-A-11-115249, pages are only grouped into monochrome blocks and color blocks. There is no consideration of the case where a variety of colors used for color printing on one page are different from a variety of colors used for color printing on the other page, for example, the case where a front page has cyan, magenta and yellow whereas a rear page has magenta, yellow and black. In such a case, the printing process may become slow.

SUMMARY OF THE INVENTION

The invention is developed upon such circumstances and an object of the invention is to provide an image-forming apparatus in which color printing using different varieties of colors can be performed speedily by simultaneous printing as well as simultaneous printing can be started speedily, so that speedy simultaneous printing can be achieved.

To achieve the object, the invention provides an image forming apparatus, including: an electrostatic latent image carrier capable of carrying an electrostatic latent image for at least two pages; an electrostatic latent image-forming unit that forms the electrostatic latent image on the electrostatic latent image carrier according to image data of each color; a plurality of developing units that develop the electrostatic latent image on the electrostatic latent image carrier by a developer of each color to form a mono-color developer image according to each color; an intermediate transfer body onto which mono-color developer images of respective colors formed by the plurality of developing units are transferred successively so as to be superposed on one another to form a multi-color developer image; a transfer unit that transfers the multi-color developer image formed on the intermediate transfer body onto a recording medium; and a simultaneous printing unit configured to form an electrostatic latent image for two pages and a mono-color developer image for two pages continuously on the electrostatic latent image carrier, to transfer the mono-color developer image for two pages successively onto the intermediate transfer body to make the intermediate transfer body carry a multi-color developer image for two pages, and to transfer the multi-color developer image for two pages onto two sheets of recording media by the transfer unit to form two multi-color images including a first multi-color image and a second multi-color image.

The simultaneous printing unit includes a simultaneous printing image data generating unit configured to generate image data of each color for simultaneous printing so that a variety of colors of image data for forming the first multi-color image coincide with a variety of colors of image data for forming the second multi-color image, when a variety of colors of developers required for forming the first multi-color image are different from a variety of colors of developers required for forming the second multi-color image.

According to this configuration, the simultaneous printing image data generating unit generates image data of each color for simultaneous printing on the basis of colors required for forming the first multi-color developer image and colors required for forming the second multi-color developer image, and the simultaneous printing unit performs simultaneous printing on two sheets of recording media on the basis of the generated image data of each color for simultaneous printing. Accordingly, the first and second sheets of recording media can be set in order at the initial stage of one printing job, so that printing on the first sheet of recording medium in the printing job can be started speedily. Even in the case where a variety of colors are required for forming the first multi-color developer image, that is, the first image is to be formed as a multi-color image whereas a variety of colors are required for forming the second multi-color developer image, that is, the second image is to be formed as a multi-color image, the simultaneous printing image data generating unit generates image data of each color for simultaneous printing on the basis of the two varieties of colors. Accordingly, even in the case where the first multi-color developer image is different in variety of colors from the second multi-color developer image, simultaneous printing can be performed speedily. As a result, speedy simultaneous printing can be achieved.

Further, the simultaneous printing image data generating unit generates image data of each color for simultaneous printing so that the variety of colors of image data required according to respective colors for forming the first multi-color image coincide with the variety of colors of image data required according to respective colors for forming the second multi-color image. Accordingly, even in the case where the variety of colors of image data required according to respective colors for forming the first multi-color image are different from the variety of colors of image data required according to respective colors for forming the second multi-color image, the two varieties of colors of image data required according to respective colors can be made coincident with each other so that efficient simultaneous printing can be achieved.

The invention may provide an image forming apparatus including: an electrostatic latent image carrier capable of carrying an electrostatic latent image for at least two pages; a storage unit configured to store image data of each color for at least two pages; an electrostatic latent image-forming unit that forms the electrostatic latent image on the electrostatic latent image carrier according to the image data of each color; a plurality of developing units for developing the electrostatic latent image on the electrostatic latent image carrier by a developer of each color to form a mono-color developer image according to each color; an intermediate transfer body onto which mono-color developer images of respective colors formed by the plurality of developing units are transferred successively so as to be superposed on one another to form a multi-color developer image; a transfer unit that transfers the multi-color developer image formed on the intermediate transfer body onto a recording medium; and a simultaneous printing unit configured to form an electrostatic latent image for two pages and a mono-color developer image for two pages continuously on the electrostatic latent image carrier, to transfer the mono-color developer image for two pages successively onto the intermediate transfer body to make the intermediate transfer body carry a multi-color developer image for two pages, and to transfer the multi-color developer image for two pages onto two sheets of recording media by the transfer unit to form two multi-color images including a first multi-color image and a second multi-color image.

The simultaneous printing unit includes a simultaneous printing image data generating unit configured to generate image data of each color for simultaneous printing on the basis of a variety of colors of developers required for forming the first multi-color image and a variety of colors of developers required for forming the second multi-color image.

The simultaneous printing unit may generate additional data to be added to the image data of each color stored in the storage unit on the basis of a variety of colors of developers required for forming the first multi-color image and a variety of colors of developers required for forming the second multi-color image. In this case, the simultaneous printing unit generates image data of each color for simultaneous printing by adding the additional data to the image data of each color stored in the storage unit. The electrostatic latent image-forming unit forms the electrostatic latent image on the electrostatic latent image carrier according to the image data of each color for simultaneous printing.

The invention may provide an image forming method including: forming an electrostatic latent image for two pages on an electrostatic latent image carrier; developing the electrostatic latent image for two pages on the electrostatic latent image carrier by a developer of each color to form a mono-color developer image for two pages of each color; transferring the mono-color developer image for two pages of respective color repeatedly on an intermediate transfer body to form a multi-color developer image for two pages on the intermediate transfer body; transferring the multi-color developer image for two pages formed on the intermediate transfer body onto two sheets of recording media to form two multi-color images including a first multi-color image and a second multi-color image.

The forming step includes: generating image data of each color for two pages for simultaneous printing so that a variety of colors of image data for forming the first multi-color image coincide with a variety of colors of image data for forming the second multi-color image, when a variety of colors of developers required for forming the first multi-color image are different from a variety of colors of developers required for forming the second multi-color image; and forming the electrostatic latent image for two pages on an electrostatic latent image carrier on the basis of the image data of each color for two pages for simultaneous printing.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
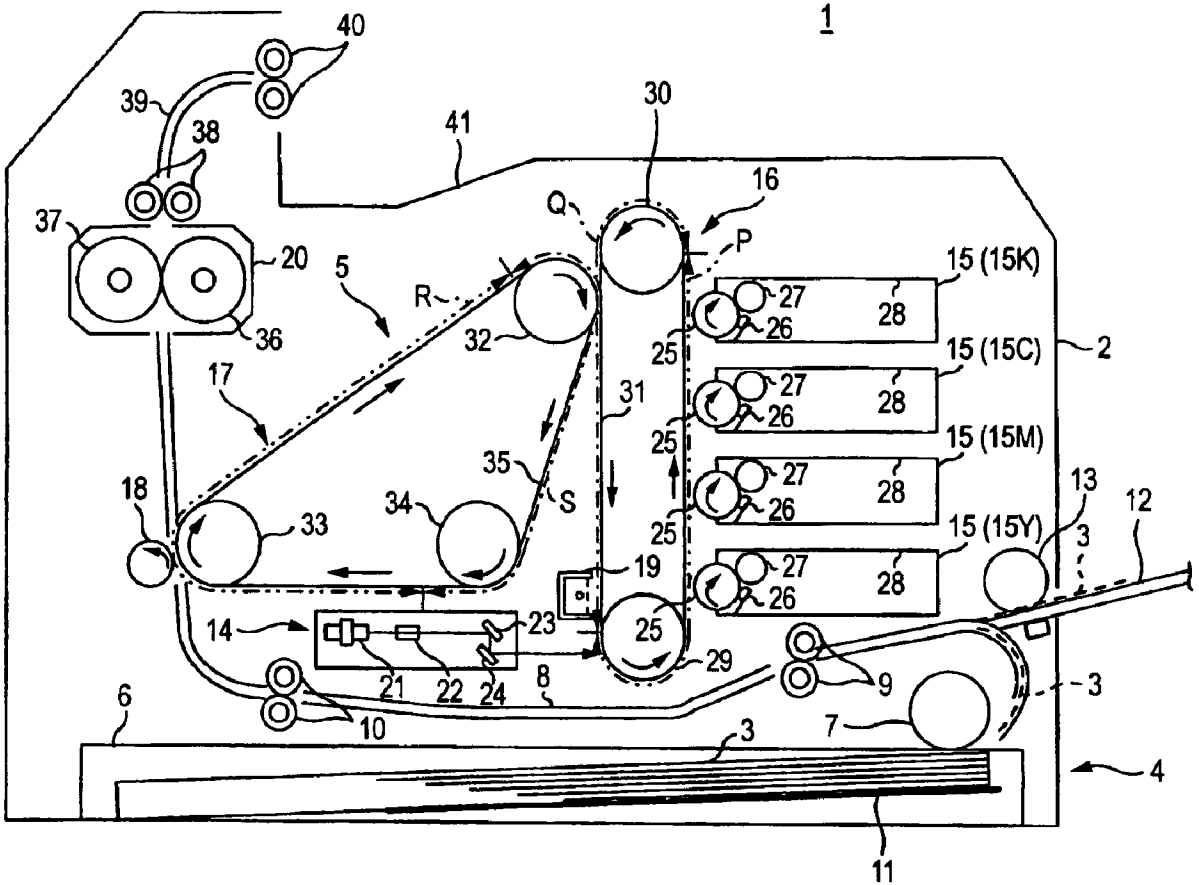
FIG. 1 is a side sectional view showing an embodiment of a color laser printer as an image forming apparatus according to the invention.

FIG. 1 is a side sectional view of important part showing an embodiment of a color laser printer 1 as an image-forming apparatus according to the invention. In FIG. 1, the color laser printer 1 is a four-cycle type color laser printer 1 having a body casing 2. A paper feed portion 4 for feeding sheets of paper 3 as a recording medium, an image-forming portion 5 for forming images on the fed sheets of paper 3, and so on, are provided in the body casing 2.

The paper feed portion 4 includes: a paper feed tray 6 detachably attached to a bottom portion in the body casing 2; a paper feed roller 7 provided on one side end portion of the paper feed tray 6 (in the color laser printer 1, the side of provision of the paper feed roller 7 is hereinafter referred to as rear side whereas the side of provision of a transfer roller 18 which will be described later is hereinafter referred to as front side); a paper feed path 8; a pair of conveying rollers 9 provided on a downstream side of the paper path 8 with respect to the paper feed roller 7 in the direction of conveying the sheets of paper 3 (an upstream or downstream side in the direction of conveying the sheets of paper 3 may be hereinafter simply referred to as upstream or downstream side); and a pair of resist rollers 10 provided on a downstream side of the paper path 8 with respect to the pair of conveying rollers 9 in the direction of conveying the sheets of paper 3.

The paper feed tray 6 is shaped like a box having an upper surface opened. The paper feed tray 6 has a paper pressing plate 1 on which the sheets of paper 3 are piled up. The paper pressing plate 11 is pivotally supported at one end portion far from the paper feed roller 7 so that the other end portion near to the paper feed roller 7 can move vertically. The paper pressing plate 11 is urged to move up from the back by a not-shown spring.

The uppermost one of the sheets of paper 3 on the paper pressing plate 11 is pressed against the paper feed roller 7 from the back of the paper pressing plate 11 by the not-shown spring while the paper feed roller 7 is rotated. In this manner, the sheets of paper 3 are fed one by one to the paper feed path 8. Incidentally, when simultaneous printing as will be described later is to be performed in the color laser printer 1, for example, A4-size sheets of paper 3 are set on the paper pressing plate 11 and fed continuously two by two to the paper feed path 8.

The paper feed path 8 is formed as a path which is once inverted upward from the upstream side end portion in which the paper feed roller 7 is disposed, extends substantially flatly from the rear side to the front side above the paper feed tray 6, extends upward from the rear side so as to be bent and passes through a transfer position (in which a transfer roller 18 and a first intermediate transfer body support roller 33 which will be described later are opposite to each other) so that the downstream side end portion of the path reaches a fixing portion 20 which will be described later.

The pair of conveying rollers 9 and the pair of resist rollers 10 are disposed on the rear side and the front side respectively so as to face the paper feed path 8.

The sheet of paper 3 fed to the paper feed path 8 by the paper feed roller 7 is once inverted and then conveyed to the pair of resist rollers 10 by the pair of conveying rollers 9 so as to move from the rear side to the front side. Then, the sheet of paper 3 is conveyed to the transfer position after resisted by the pair of resist rollers 10.

The paper feed portion 4 of the color laser printer 1 further includes: a multi-purpose tray 12 on which optional-size sheets of paper 3 such as postcards are piled up; and a multi-purpose paper feed roller 13 for feeding the sheets of paper 3 piled up on the multi-purpose tray 12.

The multi-purpose tray 12 is inclined so that the front side of the multi-purpose tray 12 falls down at the rear side of the body casing 2 so as to face between the paper feed roller 7 and the pair of conveying rollers 9 in the paper feed path 8. The multi-purpose paper feed roller 13 is disposed above the multi-purpose tray 12 so as to be opposite to the multi-purpose tray 12.

The uppermost one of the sheets of paper 3 on the multi-purpose tray 12 is fed to the paper feed path 8 by rotation of the multi-purpose paper feed roller 13. In this manner, the sheets of paper 3 on the multi-purpose tray 12 are fed one by one to the paper feed path 8. Incidentally, when simultaneous printing which will be described later is to be performed, the sheets of paper 3 set on the multi-purpose tray 12 are also fed continuously two by two to the paper feed path 8. The sheet of paper 3 fed to the paper feed path 8 is conveyed from the pair of conveying rollers 9 to the pair of resist rollers 10 and further conveyed to the transfer position after resisted by the pair of resist rollers 10 in the same manner as described above.

The image-forming portion 5 includes: a scanner unit 14 as an electrostatic latent image-forming unit; a plurality of developing cartridges 15 as developing units (e.g., four cartridges); a photosensitive belt mechanism portion 16; an intermediate transfer belt mechanism portion 17; a transfer roller 18 as a transfer unit; a scorotron charger 19; and a fixing portion 20.

The scanner unit 14 is disposed above the paper feed path 8 and below the intermediate transfer belt mechanism portion 17 in the body casing 2. The scanner unit 14 has a laser light-emitting portion (not shown), a polygon mirror 21 driven to rotate, a lens 22, and reflecting mirrors 23 and 24. In the scanner unit 14, a laser beam emitted from the laser light-emitting portion on the basis of image data is transmitted or reflected through the polygon mirror 21, the lens 22 and the reflecting mirrors 23 and 24 successively as represented by the arrow, so that the laser beam is applied, by high-speed scanning, onto a surface of a photosensitive belt 31 as an electrostatic latent image carrier of the photosensitive belt mechanism portion 16 which will be described later.

As the four developing cartridges 15, a yellow developing cartridge 15Y containing yellow toner, a magenta developing cartridge 15M containing magenta toner, a cyan developing cartridge 15C containing cyan toner and a black developing cartridge 15K containing black toner are arranged side by side in ascending order according to colors at regular intervals in the rear side of the body casing 2.

Each of the developing cartridges 15 has a developing roller 25, a layer thickness regulating blade 26, a feed roller 27, and a toner container 28. Each of the developing cartridges 15 is formed so as to be able to be moved horizontally by a not-shown developing cartridge contact/separation mechanism so that the developing roller 25 can be brought into contact with or separated from a surface of the photosensitive belt 31 which will be described later.

Positively electrically charged non-magnetic one-component toners of yellow, magenta, cyan and black as developers are contained in the toner containers 28 respectively. Polymeric toner obtained by copolymerization of polymerizable monomer, e.g., styrene monomer such as styrene or acrylic monomer such as acrylic acid, alkyl (C1 to C4) acrylate or alkyl (C1 to C4) methacrylate by a known polymerization method such as suspension polymerization is used as each of the toners. Such polymeric toner is substantially spherical and very good in fluidity.

Incidentally, an external additive such as silica is added to the toner in order to improve fluidity as well as a colorant, wax, etc. corresponding to the color is added to the toner. The particle size of the toner is selected to be in a range of from about 6 μm to about 10 μm.

In each of the developing cartridges 15, the feed roller 27 and the developing roller 25 are rotatably provided so that the two rollers 27 and 25 come into contact with each other while compressed to a certain degree. The developing roller 25 is formed so that a not-shown main motor drives the developing roller 25 to rotate upward (clockwise) at a contact portion (nip portion) between the developing roller 25 and the photosensitive belt 31 which will be described later. Further, a developing bias is applied to the developing roller 25.

The layer thickness regulating blade 26 is provided below the feed roller 27 so as to press a surface of the developing roller 25 opposite to the photosensitive belt 31.

The toner contained in each toner container 28 is fed onto the developing roller 25 by rotation of the feed roller 27. On this occasion, the toner is frictionally charged with positive polarity between the feed roller 27 and the developing roller 25. The toner fed onto the developing roller 25 further goes in between the layer thickness regulating blade 26 and the developing roller 25 with rotation of the developing roller 25, so that the toner as a thin layer having a predetermined thickness is carried on the developing roller 25.

The photosensitive belt mechanism portion 16 has a photosensitive body-support roller 29 disposed on a side of the front of the four developing cartridges 15 so as to be opposite to the yellow developing cartridge 15Y located in the lowermost position, a photosensitive body drive roller 30 disposed vertically above the photosensitive body support roller 29 so as to be opposite to the black developing cartridge 15K located in the uppermost position, and a photosensitive belt 31 made of an endless belt wound between the photosensitive body support roller 29 and the photosensitive body drive roller 30.

The photosensitive belt 31 has a photosensitive layer on its surface. The photosensitive layer is made of an organic photosensitive body. The photosensitive belt 31 is disposed vertically so as to be able to come into contact with all the developing rollers 25 oppositely. The circumferential length of the photosensitive belt 31 is selected to be substantially equal to the length of one A3-size sheet of paper 3. Accordingly, one page's A3-size mono-color toner image according to each color or two pages' A4-size mono-color toner image according to each color can be carried once as a mono-color developer image on the photosensitive belt 31.

In the photosensitive belt mechanism portion 16, motive power is transmitted from a not-shown main motor to the photosensitive body drive roller 30. The photosensitive body drive roller 30 is driven to rotate counterclockwise. The photosensitive body support roller 29 is also driven counterclockwise following the rotation. Thereby, the photosensitive belt 31 is circulated counterclockwise between the photosensitive body support roller 29 and the photosensitive body drive roller 30.

As a result, the photosensitive belt 31 is moved from the developing roller 25 of the yellow developing cartridge 15Y located in the uppermost position to the developing roller 25 of the black developing cartridge 15K located in the lowermost position, that is, the photosensitive belt 31 is moved up in the same direction as each of the developing rollers 25 at the contact portion (nip portion) in which the photosensitive belt 31 comes into contact with each of the developing rollers 25.

The intermediate transfer belt mechanism portion 17 is disposed above the scanner unit 14 and on a side of the front of the photosensitive belt mechanism portion 16. The intermediate transfer belt mechanism portion 17 has an intermediate transfer body drive roller 32, a first intermediate transfer body support roller 33, a second intermediate transfer body support roller 34, and an intermediate transfer belt 35 as an intermediate transfer body made of an endless belt.

The intermediate transfer body drive roller 32 is disposed opposite to the photosensitive body drive roller 30 so that the photosensitive belt 31 and the intermediate transfer belt 35 are sandwiched between the two rollers 32 and 30. The first intermediate transfer body support roller 33 is disposed in an obliquely front position below the intermediate transfer body drive roller 32. The first intermediate transfer body support roller 33 is disposed opposite to the transfer roller 18 which will be described later so that the intermediate transfer belt 35 is sandwiched between the two rollers 33 and 18. The second intermediate transfer body support roller 34 is disposed below the intermediate transfer body drive roller 32 and in the rear side of the first intermediate transfer body support roller 33. The intermediate transfer body drive roller 32, the first intermediate transfer body support roller 33 and the second intermediate transfer body support roller 34 are arranged substantially triangularly and circumferentially wound with the intermediate transfer belt 35.

The intermediate transfer belt 35 is made of an electrically conductive resin such as polycarbonate or polyimide containing electrically conductive particles such as carbon particles dispersed therein. The circumferential length of the intermediate transfer belt 35 is selected according to the circumferential length of the photosensitive belt 31, that is, to be such a length that a multi-color toner image obtained by successive superposition of one-page's A3-size mono-color toner images of the photosensitive belt 31 according to respective colors or a multi-color toner image obtained by successive superposition of two-pages' A4-size mono-color toner images of the photosensitive belt 31 according to respective colors can be carried as a multi-color developer image at one time.

The intermediate transfer belt mechanism portion 17 is formed so that motive power transmitted from the not-shown main motor to the intermediate transfer body drive roller 32 drives the intermediate transfer body drive roller 32. The intermediate transfer body drive roller 32 is driven to rotate clockwise. The first and second intermediate transfer body support rollers 33 and 34 is driven clockwise following the rotation. Thereby the intermediate transfer belt 35 is circulated clockwise among the intermediate transfer body drive roller 32 and the first and second intermediate transfer body support rollers 33 and 34.

Accordingly, the intermediate transfer belt 35 comes into contact with the photosensitive belt 31 oppositely on the intermediate transfer body drive roller 32, so that the intermediate transfer belt 35 is moved in the same direction as the photosensitive belt 31 at the contact portion (nip portion) between the two belts 35 and 31. As will be described later, at the contact portion (nip portion), mono-color toner images carried on the photosensitive belt 31 according to respective colors are transferred successively onto the intermediate transfer belt 35.

The transfer roller 18 is disposed opposite to the first intermediate transfer body support roller 33 of the intermediate transfer belt mechanism portion 17 so as to come into contact with a surface of the intermediate transfer belt 35 sandwiched between the rollers 18 and 33. The transfer roller 18 is formed so as to rotate (counterclockwise) in the reverse direction to the intermediate transfer belt 35 at the contact portion (nip portion) between the transfer roller 18 and the intermediate transfer belt 35. Incidentally, the transfer roller 18 is formed so that a not-shown transfer roller contact/separation mechanism moves the transfer roller 18 to the contact portion in which the transfer roller 18 comes into contact with the intermediate transfer belt 35 when a multi-color toner image is transferred onto the sheet of paper 3, but moves the transfer roller 18 to the separation position in which the transfer roller 18 is separated from the intermediate transfer belt 35 when transfer is not made.

The transfer roller 18 is formed so as to be driven by the not-shown main motor so that a transfer bias is applied to the transfer roller 18.

The scorotron charger 19 is disposed opposite to a surface of the photosensitive belt 31 with separation of a predetermined distance and provided on an upstream side near the photosensitive body support roller 29 in the direction of movement of the photosensitive belt 31. The scorotron charger 19 is a positively charged scorotron charger for generating corona discharge from an electrically charged wire such as a tungsten wire. The scorotron charger 19 is formed so that a surface of the photosensitive belt 31 is electrically charged with positive polarity evenly.

After electrically positively charged evenly by the scorotron charger 19, the surface of the photosensitive belt 31 is exposed to a laser beam by high-speed laser beam scanning from the scanner unit 14 to thereby form an electrostatic latent image based on image data.

Then, a not-shown developing cartridge contact/separation mechanism brings the developing roller 25 of a specific developing cartridge 15 into contact with the photosensitive belt 31 on which the electrostatic latent image is formed. As a result, a mono-color toner image as a mono-color developer image of the toner contained in the specific developing cartridge 15 is formed on the photosensitive belt 31. When the mono-color toner image formed on the photosensitive belt 31 then faces the intermediate transfer belt 35, the mono-color toner image is transferred onto the intermediate transfer belt 35. In this manner, mono-color toner images are transferred onto the intermediate transfer belt 35 successively so as to be superposed on one another, so that a multi-color toner image is formed as a multi-color developer image.

The color laser printer 1 is formed so that either ordinary printing or simultaneous printing selected by a printing selection program as a comparison unit which will be described later is performed. In ordinary printing, each multi-color toner image is formed on the intermediate transfer belt 35 and transferred onto a sheet of paper 3 by the transfer roller 18. In simultaneous printing, two-pages' multi-color toner images are formed simultaneously on the intermediate transfer belt 35 and transferred continuously onto two sheets of paper 3 by the transfer roller 18.

Ordinary printing is performed by an ordinary printing program as ordinary printing means stored in an ROM 57 which will be described later.

When, for example, ordinary printing is to be performed on A4-size sheets of paper 3, one-page's region on the photosensitive belt 31 (that is, either region P or region Q as a half of the photosensitive belt 31), for example, the region P, is first electrically positively charged evenly by the scorotron charger 19. Then, an electrostatic latent image based on the image data of yellow is formed on the region P by high-speed laser beam scanning from the scanner unit 14.

Then, the yellow developing cartridge 15Y located in the lowermost position is moved horizontally forward by the not-shown developing cartridge contact/separation mechanism so that the developing roller 25 of the yellow developing cartridge 15Y comes into contact with the region P of the photosensitive belt 31 on which the electrostatic latent image based on the image data of yellow is formed. At the same time, the magenta developing cartridge ISM, the cyan developing cartridge 15C and the black developing cartridge 15K are moved horizontally rearward by the not-shown developing cartridge contact/separation mechanism so that the developing rollers 25 of the cartridges 15M, 15C and 15K are separated from the photosensitive belt 31. As a result, a yellow toner image of the yellow toner contained in the yellow developing cartridge 15Y is formed on the region P of the photosensitive belt 31. Then, when the photosensitive belt 31 is moved so that the yellow toner image faces the intermediate transfer belt 35, the yellow toner image formed on the region P of the photosensitive belt 31 is transferred onto one-page's region on the intermediate transfer belt 35 (that is, either region R or region S as a half of the intermediate transfer belt 35), for example, the region R.

Then, an electrostatic latent image based on image data of magenta is formed on the region P of the photosensitive belt 31 again in the same manner as described above. On the other hand, the respective developing cartridges 15 are moved horizontally suitably by the not-shown developing cartridge contact/separation mechanism so that the developing roller 25 of the magenta developing cartridge 15M located in the second lowest position comes into contact with the region P of the photosensitive belt 31 but the other developing rollers 25 are separated from the photosensitive belt 31. As a result, a magenta toner image of the magenta toner contained in the magenta developing cartridge ISM is formed on the region P of the photosensitive belt 31. When the magenta toner image faces the region R of the intermediate transfer belt 35, the magenta toner image is transferred onto the region R of the intermediate transfer belt 35 so as to be superposed on the yellow toner image which has been already transferred onto the region R of the intermediate transfer belt 35.

The same operation as described above is repeated for the cyan toner contained in the cyan developing cartridge 15C and the black toner contained in the black developing cartridge 15K. As a result, a multi-color image is formed on the region R of the intermediate transfer belt 35.

The multi-color toner image formed on the region R of the intermediate transfer belt 35 in the aforementioned manner is collectively transferred onto a sheet of paper 3 whenever the sheet of paper 3 passes between the intermediate transfer belt 35 and the transfer roller 18 moved to the contact position.

Incidentally, when, for example, such ordinary printing is to be performed on A3-size sheets of paper 3, one-page's mono-color toner image is formed on all the regions P and Q of the photosensitive belt 31 and one-page's multi-color toner image is formed on all the regions S and R of the intermediate transfer belt 35 and transferred onto an A3-size sheet of paper 3 by the transfer roller 18.

The embodiment has been described on the case where all the colors of yellow, magenta, cyan and black are superposed on one another to form a multi-color toner image on the photosensitive belt 31. As will be described, however, image data (printing image data) of respective colors corresponding to actual toner colors required for forming an image of printing data to be expanded are suitably selected when the multi-color toner image is formed. Accordingly, the invention may be also applied to the case where a toner image of a single color (e.g., only black) is formed on the photosensitive belt 31. In addition, when a multi-color toner image is formed, the number of colors required for forming the multi-color toner image may be two or three.

Figure 5:
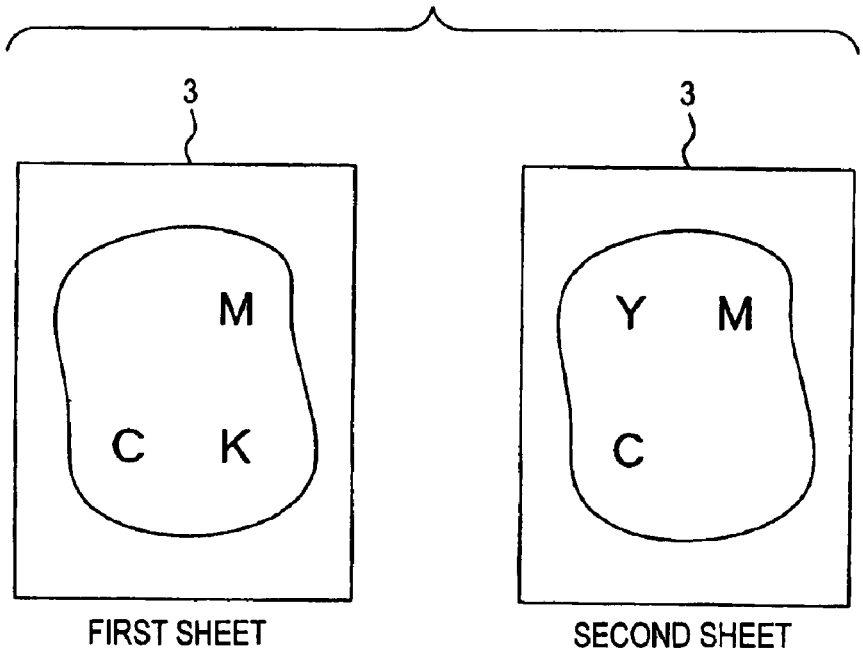
FIG. 5 is a view showing another example of printing image data transferred onto first and second sheets (in the case where the printing image data for the first sheet is partially different from the printing image data for the second sheet).
Figure 6:
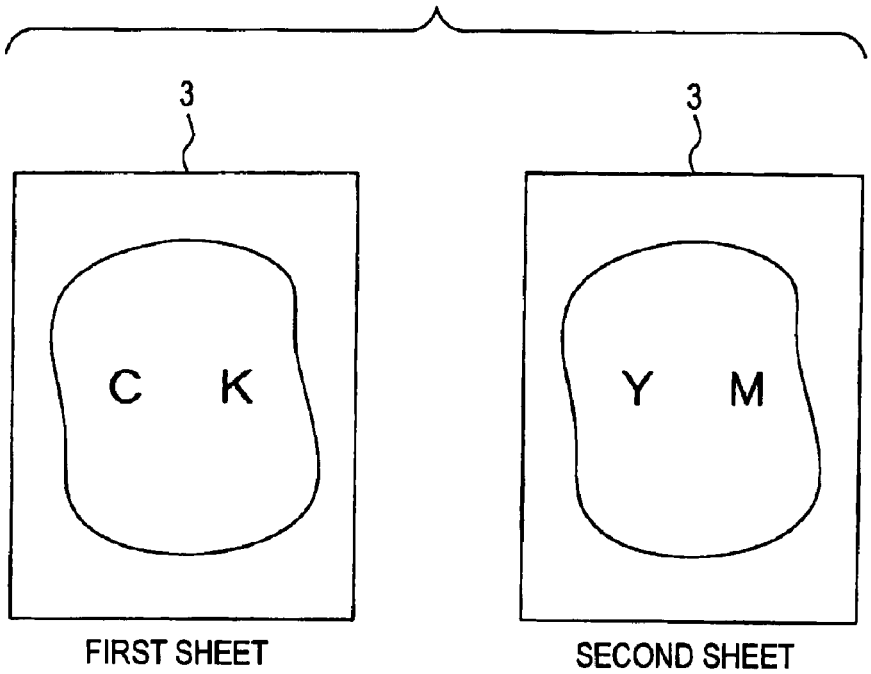
FIG. 6 is a view showing a further example of printing image data transferred onto first and second sheets (in the case where the printing image data for the first sheet is entirely different from the printing image data for the second sheet).

In such ordinary printing, if necessary, the intermediate transfer belt 35 is idly rotated in order to reduce the influence of a residual image after transferring whenever transferring of the toner image onto a sheet of paper 3 is completed. An ordinary printing program judges whether idle rotation is required or not, and sets the number of idle rotations on the basis of a combination of image data already transferred for printing the first image and a combination of image data to be transferred for printing the second image when idle rotation needs to be performed. When, for example, image data for printing the first image contains C (cyan) and K (black) and image data for printing the second image contains Y (yellow) and M (magenta) as shown in FIG. 6, idle rotation is not performed, that is, the number of idle rotations is set to "0". When, for example, image data for printing the first image contains M (magenta), C (cyan) and K (black) and image data for printing the second image contains Y (yellow), M (magenta) and C (cyan) as shown in FIG. 5, the number of idle rotations is set to "2".

Simultaneous printing is performed by a simultaneous printing program as simultaneous printing means stored in an ROM 57 which will be described later.

When, for example, simultaneous printing is to performed on A4-size sheets of paper, the one-page's regions of the photosensitive belt 31, that is, the two regions P and Q as halves of the photosensitive belt 31 are electrically positively charged evenly by the scorotron charger 19 and then electrostatic latent images are formed on the regions P and Q respectively by high-speed laser beam scanning from the scanner unit 14 in such a manner that an electrostatic latent image based on the yellow image data for printing the first image is formed on the region P and an electrostatic latent image based on the yellow image data for printing the second image is formed on the region Q.

Then, the yellow developing cartridge 15Y located in the lowermost position is moved horizontally by the not-shown developing cartridge contact/separation mechanism so that the developing roller 25 of the yellow developing cartridge 15Y comes into contact with the regions P and Q of the photosensitive belt 31 on which the electrostatic latent images based on the yellow image data are formed. At the same time, the magenta developing cartridge 15M, the cyan developing cartridge 15C and the black developing cartridge 15K are moved horizontally rearward by the not-shown developing cartridge contact/separation mechanism so that the developing rollers 25 of the cartridges 15M, 15C and 15K are separated from the photosensitive belt 31. As a result, yellow toner images for the first and second images are formed on the regions P and Q of the photosensitive belt 31 respectively. When the photosensitive belt 31 is then moved so that the yellow toner images face the intermediate transfer belt 35, the yellow toner images formed on the regions P and Q of the photosensitive belt 31 are transferred from the regions P and Q onto the one-page's regions of the intermediate transfer belt 35, that is, onto the regions R and S as halves of the intermediate transfer belt 35 respectively. In this manner, the yellow toner images for the first and second images are transferred onto the regions R and S respectively.

Then, electrostatic latent images based on the magenta image data are formed on the regions P and Q of the photosensitive belt 31 again in the same manner as described above. On the other hand, the respective developing cartridges 15 are moved horizontally suitably by the not-shown developing cartridge contact/separation mechanism so that the developing roller 25 of the magenta developing cartridge 15M located in the second lowest position comes into contact with the regions P and Q of the photosensitive belt 31 while the other developing rollers 25 are separated from the photosensitive belt 31. As a result, magenta toner images for the first and second images based on the magenta toner contained in the magenta developing cartridge 15M are formed on the regions P and Q of the photosensitive belt 31. When the magenta toner images then face the regions R and S of the intermediate transfer belt 35, the magenta toner images are transferred onto the regions R and S of the intermediate transfer belt 35 so as to be superposed on the yellow toner images which have been transferred onto the regions R and S of the intermediate transfer belt 35.

The same operation as described above is repeated for the cyan toner contained in the cyan developing cartridge 15C and the black toner contained in the black developing cartridge 15K. As a result, first and second multi-color toner images are formed on the regions R and S of the intermediate transfer belt 35 respectively.

The two-pages' multi-color toner images formed on the intermediate transfer belt 35 are transferred continuously onto two continuously fed A4-size sheets of paper 3 by the transfer roller 18 while the intermediate transfer belt 35 makes one rotation.

According to the simultaneous printing, two A4-size sheets of paper 3 can be printed substantially simultaneously, so that the printing speed can be made higher surely.

In this embodiment, all the colors of yellow, magenta, cyan and black are superposed on one another to form multi-color toner images on the intermediate transfer belt 35 in the same manner as in ordinary printing. Also in simultaneous printing, the multi-color toner images, however, can be selected suitably on the basis of printing image data for printing data expanded at that time. Because of hardware characteristic of the color laser printer 1, such simultaneous printing can be performed only when image data for printing the first image is the same as image data for printing the second image except that dummy data are generated by a dummy data generating program as simultaneous printing image data generating means which will be described later.

The fixing portion 20 is disposed above the transfer roller 18 and in a downstream side end portion of the paper feed path 8. The fixing portion 20 has a heating roller 36, a pressing roller 37 for pressing the heating roller 36, and a pair of conveying rollers 38. The heating roller 36 is made of a metal and has a halogen lamp for heating. The multi-color toner image transferred onto a sheet of paper 3 between the intermediate transfer belt 35 and the transfer roller 18 is thermally fixed while the sheet of paper 3 passes between the heating roller 36 and the pressing roller 37.

The sheet of paper 3 on which the multi-color toner image is thermally fixed by the fixing portion 20 in this manner is conveyed to a paper delivery path 39 by the pair of conveying rollers 38 and delivered onto a paper delivery tray 41 formed on an upper portion of the body casing 2, by a pair of paper delivery rollers 40 provided in a downstream side end portion of the paper delivery path 39.

Figure 2:
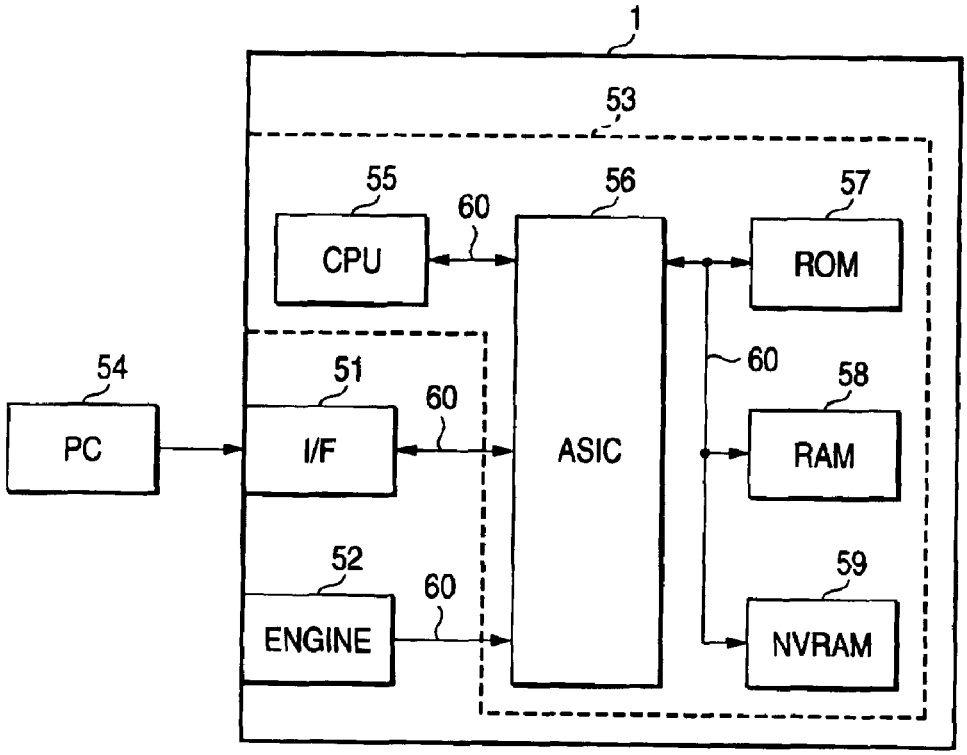
FIG. 2 is a block diagram showing the electrical configuration of the color laser printer depicted in FIG. 1.

FIG. 2 is a block diagram showing the electrical configuration of the color laser printer 1.

In FIG. 2, the color laser printer 1 includes an interface (I/F) 51, an engine 52, and a control board 53. The color laser printer 1 is connected to an external PC (personal computer) 54 through the interface 51. The engine 52 has various kinds of mechanical members including the paper feed portion 4 and the image-forming portion 5 provided according to the printing operation of the color laser printer 1.

A CPU (central processing unit) 55, an ASIC (application specific integrated circuits) 56, an ROM (read only memory) 57, an RAM (random access memory) 58 and an NVRAM (non-volatile random access memory) 59 are provided on the control board 53.

The CPU 55 forms the center of control in the color laser printer 1. As will be described later, the CPU 55 performs control of the printing operation on the basis of various kinds of programs stored in the ROM 57.

The ASIC 56 is an IC for connecting the CPU 55 to the ROM 57, the RAM 58 and the NVRAM 59. The ASIC 56 is connected to the IC 55, the ROM 57, the RAM 58 and the NVRAM 59 by a bus 60. The ASIC 56 is also connected to the interface 51 and the engine 52 by the bus 60.

Various kinds of programs for controlling the color laser printer 1 are stored in the ROM 57. For example, a printing program (including a printing selection program, an ordinary printing program, a simultaneous printing program and a dummy data generating program which will be described later) for performing a printing job is stored in the ROM 57.

The RAM 58 is a volatile memory for storing numerical values temporarily. For example, a printing job, etc., input from the PC 54 is stored in the RAM 58.

The NVRAM 59 is a nonvolatile memory in which stored data remain even in the case where the color laser printer 1 is powered off or reset. For example, a page counter is stored in the NVRAM 59.

In the color laser printer 1, when a printing job is input from the PC 54 into the RAM 58 through the interface 51, the printing program stored in the ROM 57 is started. As a result, the CPU 55 controls the printing operation of the engine 52 so that printing data contained in the input printing job are page by page subjected to a printing process.

In the printing process, in the color laser printer 1, the printing selection program included in the printing program compares continuous two-pages' printing data (hereinafter, front one of the continuous two-pages' printing data is referred to as first printing data and rear one thereof is referred to as second printing data) in the printing job to thereby select whether ordinary printing or simultaneous printing is performed.

Figure 3:
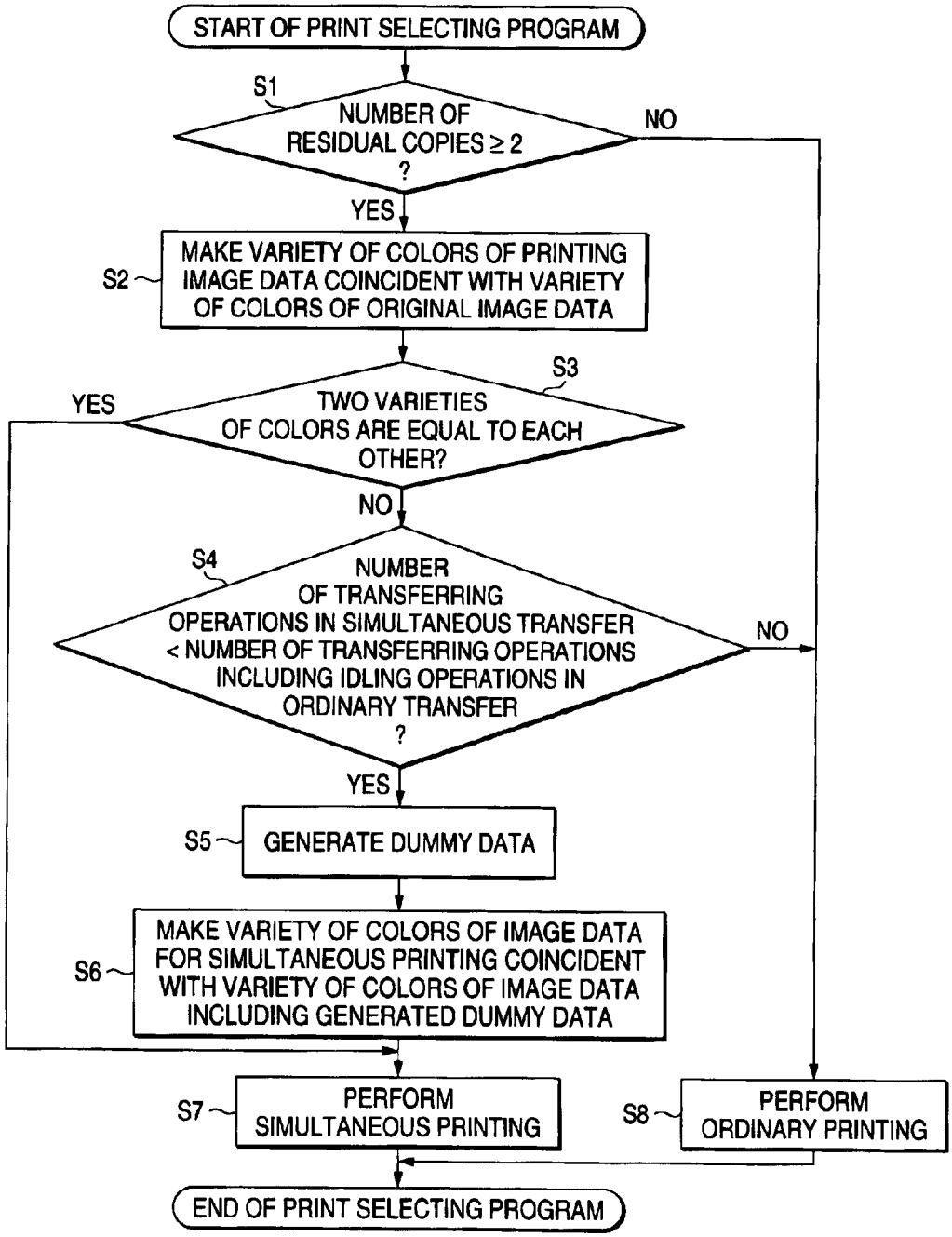
FIG. 3 is a flow chart showing processing of a transfer selection program.

FIG. 3 is a flow chart showing processing in the printing selection program. The processing in the printing selection program will be described below with reference to FIG. 3.

The processing is performed for page printing data (first printing data) and next page printing data (second printing data) after the printing job is input but before printing data for the first page is expanded. The processing is also performed whenever expansion of printing data for the following page is completed. In simultaneous printing, the processing is performed after expansion of printing data for the second sheet of paper 3 is completed.

When the processing is started, a judgment is first made as to whether the number of remaining copies is larger than 1 or not (S1).

When the number of remaining copies is not larger than 1, that is, when the number of remaining copies is 1 (S1: NO), ordinary printing is performed by the ordinary printing program without advance of the processing because simultaneous printing cannot be performed (S8).

On the other hand, when the number of remaining copies is larger than 1 (S1: YES), the variety of colors of original image data in the first printing data is set as the variety of colors of image data for printing the first page and the variety of colors of original image data in the second printing data is set as the variety of colors of image data for printing the second page (S2).

Then, a judgment is made as to whether the variety of colors of image data for printing the first page coincide with the variety of colors of image data for printing the second page or not (S3).

Figure 4:
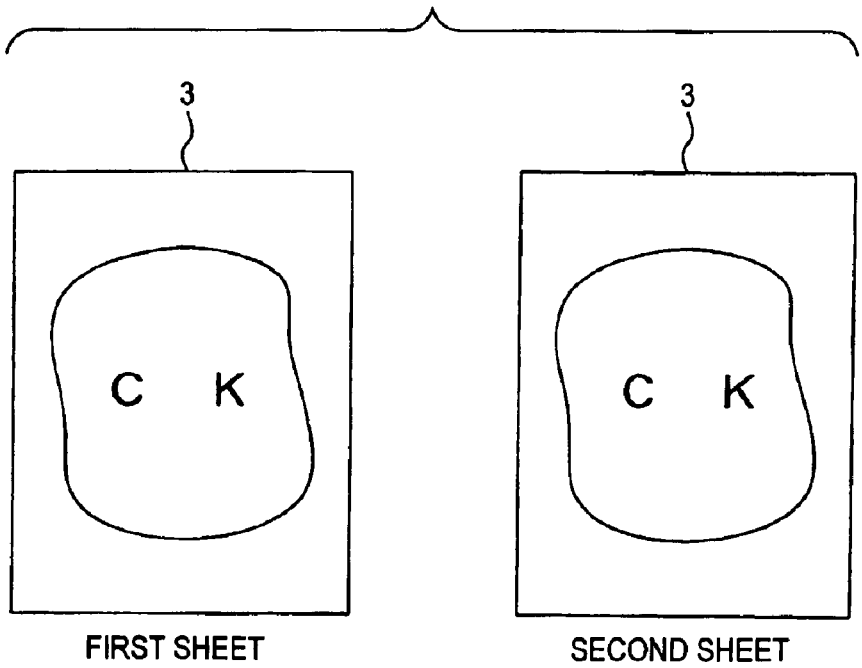
FIG. 4 is a view showing an example of printing image data transferred onto first and second sheets (in the case where the printing image data for the first sheet is the same as the printing image data for the second sheet).

When, for example, the variety of colors of image data for printing the first page are C (cyan) and K (black) and the variety of colors of image data for printing the second page are C (cyan) and K (black) as shown in FIG. 4, the variety of colors of image data for printing the first page coincide with the variety of colors of image data for printing the second page (S3: YES). Accordingly, in this case, simultaneous printing is performed soon by the simultaneous printing program (S7).

On the other hand, when, for example, the variety of colors of image data for printing the first page are C (cyan), M (magenta) and K (black) and the variety of colors of image data for printing the second page are Y (yellow), M (magenta) and C (cyan) as shown in FIG. 5, K (black) in the variety of colors of image data for printing the first page does not coincide with Y (yellow) in the variety of colors of image data for printing the second page (i.e., simultaneous printing cannot be performed directly because of hardware characteristic of the color laser printer 1) (S3: NO). Accordingly, in this case, a judgement is made as to whether or not the number of rotations (the number of transferring operations in simultaneous printing) of the intermediate transfer belt 35 in the case where simultaneous printing is performed on two sheets of paper 3 on the basis of the variety of colors of image data for printing the first page and the variety of colors of image data for printing the second page is smaller than the total number of rotations of the intermediate transfer belt 35 (the sum of the number of transferring operations and the number of idle rotations in ordinary printing (hereinafter also referred to as the total number of transferring operations in ordinary transfer)) as the sum of the number of rotations of the intermediate transfer belt 35 and the number of idle rotations required before transferring of the second image after transferring of the first image in the case where two sheets of paper 3 are subjected to ordinary printing on the basis of the variety of colors of image data for printing the first page and the variety of colors of image data for printing the second page (S4).

In S4, the number of transferring operations in simultaneous printing is calculated as a value obtained by subtraction of the number of duplicate colors between the variety of colors of image data for printing the first page and the variety of colors of image data for printing the second page from the sum of the number of colors of image data for printing the first page and the number of colors of image data for printing the second page. On the other hand, the number of transferring operations in ordinary printing is calculated as the sum of the number of colors of image data for printing the first page and the number of colors of image data for printing the second page.

When, for example, the variety of colors of image data for printing the first page are C (cyan) and K (black) and the variety of colors of image data for printing the second page are Y (yellow) and M (magenta) as shown in FIG. 6, the number of transferring operations in simultaneous printing is "4" as a value obtained by subtraction of the number "0" of duplicate colors of image data between the variety of colors of image data for printing the first page and the variety of colors of image data for printing the second page from the sum of the number "2" of colors of image data for printing the first page and the number "2" of colors of image data for printing the second page. The number of transferring operations in ordinary printing is "4" as the sum of the number "2" of colors of image data for printing the first page and the number "2" of colors of image data for printing the second page. When the number of idle rotations is set to "0" as described above in the combination of colors of image data for printing the respective pages as shown in FIG. 6, the total number of transferring operations in ordinary printing is "4" (="4"+"0").

In this case, the number "4" of transferring operations in simultaneous printing is equal to the number "4" of transferring operations in ordinary printing (S4: NO). Accordingly, ordinary printing is performed because the printing speed of simultaneous printing is equal to that of ordinary printing even in the case where simultaneous printing is performed.

When such ordinary printing is performed, the printing selection program is restarted with the second and third pages regarded as the first and second pages respectively after ordinary printing of the first page, so that selection of simultaneous printing or ordinary printing is performed again.

When, for example, the variety of colors of image data for printing the first page are M (magenta), C (cyan) and K (black) and the variety of colors of image data for printing the second page are Y (yellow), M (magenta) and C (cyan) as shown in FIG. 5, the number of transferring operations in simultaneous printing is calculated as a value obtained by subtraction of the number "2" of duplicate colors of image data, that is, M (magenta) and C (cyan) between the variety of colors of image data for printing the first page and the variety of colors of image data for printing the second page from the sum "3"+"3" of the number "3" of colors of image data for printing the first page, that is, C (cyan), M (magenta) and K (black), and the number "3" of colors of image data for printing the second page, that is, Y (yellow), M (magenta) and C (cyan). That is, the number of transferring operations in simultaneous printing is calculated as "4" (="3"+"3"−"2").

The number of transferring operations in ordinary printing is calculated as the sum "6" (="3"+"3") of the number "3" of colors of image data for printing the first page, that is, C (cyan), M (magenta) and K (black), and the number "3" of colors of image data for printing the second page, that is, Y (yellow), M (magenta) and C (cyan).

When the number of idle rotations is set to "2" as described above in the combination of image data for printing the respective pages as shown in FIG. 5, the total number of transferring operations in ordinary printing is calculated as "8" (="6"+"2").

In this case, the number "4" of transferring operations in simultaneous printing is smaller than (in fact, half of) the total number "8" of transferring operations in ordinary printing (S4: YES). Accordingly, if simultaneous printing is performed, the printing speed of simultaneous printing is higher than that of ordinary printing. Then, dummy data are generated by the dummy data generating program (S5).

The dummy data are generated as follows in order that the variety of colors of image data contained in the first printing data coincide with the variety of colors of image data contained in the second printing data. Image data of a color not contained in the variety of colors of image data for printing the first page but contained in the variety of colors of image data for printing the second page is generated as dummy data for the first page, so that the dummy data for the first page and image data (original image data) of the variety of colors for printing the first page form image data for the first page. Image data of a color not contained in the variety of colors of image data for printing the second page but contained in the variety of colors of image data for printing the first page is generated as dummy data for the second page so that the dummy data for the second page and the variety of colors of image data (original image data) for printing the second page form image data for the second page.

Figure 7:
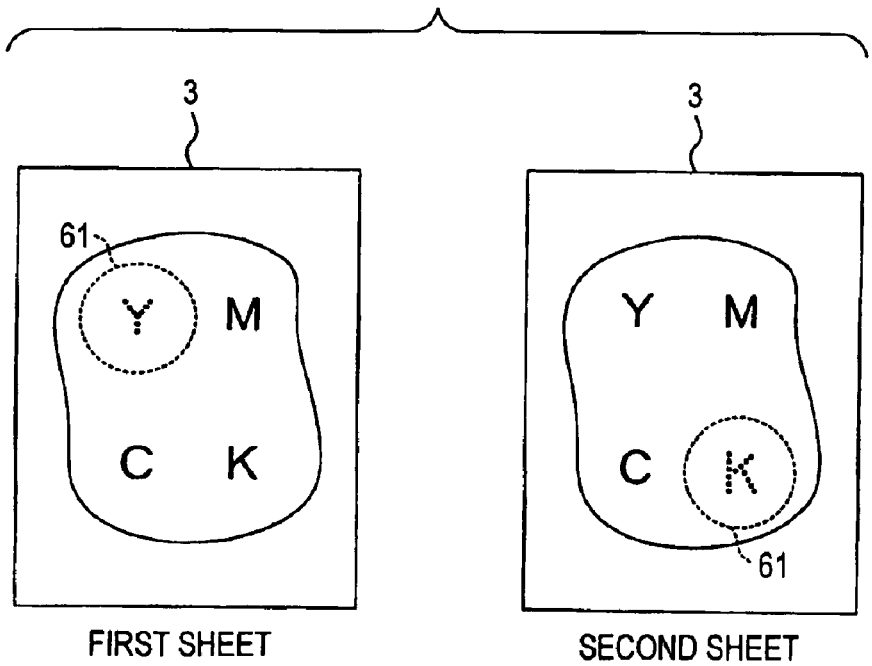
FIG. 7 is a view showing a further example of printing image data transferred onto first and second sheets (in the case where the printing image data for the first and second sheets contain dummy data respectively).

When, for example, the variety of colors of image data for printing the first page are M (magenta), C (cyan) and K (black) and the variety of colors of image data for printing the second page are Y (yellow), M (magenta) and C (cyan) as shown in FIG. 5, image data of Y (yellow) not contained in the variety of colors of image data for printing the first page but contained in the variety of colors of image data for printing the second page is generated as dummy data 61 for the first page as shown in FIG. 7 in addition to M (magenta), C (cyan) and K (black) which are the variety of colors of image data for printing the first page. Image data of K (black) not contained in the variety of colors of image data for printing the second page but contained in the variety of colors of image data for printing the first page is generated as dummy data 61 for the second page in addition to Y (yellow), M (magenta) and C (cyan) which are the variety of colors of image data for printing the second page.

Incidentally, in generation of dummy data 61 by the dummy data generating program, for example, dummy data 61 having a pixel value "0" is generated according to a known method. For example, in the case shown in FIGS. 5 and 7, dummy data of Y (yellow) having a pixel value "0" is added to printing data as image data for the first page and dummy data of K (black) having a pixel value "0" is added to printing data as image data for the second page.

When such dummy data are generated, image data contained in the first printing data can be made formally coincident with image data contained in the second printing data by the dummy data 61 generated for the first and second pages respectively even in the case where the variety of colors of image data for printing the first page are different from the variety of colors of image data for printing the second page.

After the dummy data 61 are generated in this manner, in this processing, image data for printing the first and second pages are set again as image data for simultaneous printing including the dummy data (S6).

In this process, simultaneous printing is performed by the simultaneous printing program on the basis of the image data set again for simultaneous printing of the first and second pages (S7).

More specifically, when image data for simultaneous printing as shown in the case of FIG. 7 are to be simultaneously printed on A4-size sheets of paper 3, a toner image of Y (yellow) is first formed on the photosensitive belt 31 on the basis of the yellow image data in the image data for simultaneous printing of the first and second pages. In the formation of the toner image based on the Y (yellow) image data, since the image data of Y (yellow) for the first page is dummy data 61 having the pixel value set to "0", an electrostatic latent image based on the image data of Y (yellow) for the first page is not formed due to no laser beam emitted from the scanner unit 14 applied to the region P as a half of the photosensitive belt 31 even in the case where the region P reaches a point irradiated with the laser beam. For this reason, even in the case where the region P reaches a position facing the developing roller 25 of the yellow developing cartridge 15Y with the movement of the photosensitive belt 31 so that the developing roller 25 of the yellow developing cartridge 15Y is brought into contact with the region P of the photosensitive belt 31 by the developing cartridge contact/separation mechanism, the region P is not developed so that the yellow toner image is not formed on the region P. Even in the case where the region P of the photosensitive belt 31 faces the intermediate transfer belt 35 with further movement of the photosensitive belt 31, the yellow toner image for the first page is not transferred onto the region R of the intermediate transfer belt 35 corresponding to the region P of the photosensitive belt 31 because the yellow toner image is not formed on the region P.

On the other hand, when the other region Q of the photosensitive belt 31 reaches a point irradiated with a laser beam emitted from the scanner unit 14, the region Q is irradiated with a laser beam in order to form a yellow toner image based on image data of Y (yellow) for the second page. As a result, an electrostatic latent image based on the image data of Y (yellow) for the second page is formed on the region Q. When the region Q having the electrostatic latent image formed thereon reaches a position facing the developing roller 25 of the yellow developing cartridge 15Y with the movement of the photosensitive belt 31, the developing roller 25 of the yellow developing cartridge 15Y being still in contact with the photosensitive belt 31 from the region P by the not-shown developing cartridge contact/separation mechanism develops the electrostatic latent image on the region Q of the photosensitive belt 31. As a result, a yellow toner image for the second page is formed on the region Q of the photosensitive belt 31.

When the electrostatic latent image on the region Q of the photosensitive belt 31 is entirely developed, the developing roller 25 of the yellow developing cartridge 15Y is separated from the photosensitive belt 31 by the developing cartridge contact/separation mechanism. When the photosensitive belt 31 is then further moved so that the region Q of the photosensitive belt 31 faces the intermediate transfer belt 35, the yellow toner image formed on the region Q is transferred onto the region S of the intermediate transfer belt 35 corresponding to the region Q of the photosensitive belt 31.

While the yellow toner image on the region Q is transferred onto the region S of the intermediate transfer belt 35, a laser beam emitted from the scanner unit 14 is applied onto the region P of the photosensitive belt 31 at a point irradiated with the laser beam in order to successively form a magenta toner image based on image data of M (magenta) for the first page. As a result, an electrostatic latent image based on the image data of M (magenta) for the first page is formed on the region P. When the region P having the electrostatic latent image formed thereon reaches a position facing the developing roller 25 of the magenta developing cartridge 15M with the movement of the photosensitive belt 31, the developing roller 25 of the magenta developing cartridge 15M is brought into contact with the region P of the photosensitive belt 31 by the not-shown developing cartridge contact/separation mechanism, so that the electrostatic latent image on the region P is developed. As a result, a magenta toner image for the first page is formed on the region P of the photosensitive belt 31.

When the photosensitive belt 31 is then further moved so that the region P of the photosensitive belt 31 faces the intermediate transfer belt 35, the magenta toner image formed on the region P is transferred onto the region R of the intermediate transfer belt 35 corresponding to the region P of the photosensitive belt 31.

While the magenta toner image on the region P is transferred onto the region R of the intermediate transfer belt 35, a laser beam emitted from the scanner unit 14 is applied onto the region Q of the photosensitive belt 31 at a point irradiated with the laser beam in order to successively form a magenta toner image based on image data of M (magenta) for the second page. As a result, an electrostatic latent image based on the image data of M (magenta) for the second page is formed on the region Q. When the region Q having the electrostatic latent image formed thereon reaches a position facing the developing roller 25 of the magenta developing cartridge 15M with the movement of the photosensitive belt 31, the developing roller 25 of the magenta developing cartridge 15M being still in contact with the photosensitive belt 31 from the region P by the not-shown developing cartridge contact/separation mechanism develops the electrostatic latent image on the region Q of the photosensitive belt 31. As a result, a magenta toner image for the second page is formed on the region Q of the photosensitive belt 31.

When the electrostatic latent image on the region Q of the photosensitive belt 31 is entirely developed, the developing roller 25 of the magenta developing cartridge 15M is separated from the photosensitive belt 31 by the developing cartridge contact/separation mechanism.

When the photosensitive belt 31 is then further moved so that the region Q of the photosensitive belt 31 faces the intermediate transfer belt 35, the magenta toner image formed on the region Q is transferred onto the region S of the intermediate transfer belt 35 corresponding to the region Q of the photosensitive belt 31 so as to be superposed on the yellow toner image which has been already transferred on the region S of the intermediate transfer belt 35.

While the magenta toner image on the region Q is transferred onto the region S of the intermediate transfer belt 35, a laser beam emitted from the scanner unit 14 is applied onto the region P of the photosensitive belt 31 at a point irradiated with the laser beam in order to successively form a cyan toner image based on image data of C (cyan) for the first page. As a result, an electrostatic latent image based on the image data of C (cyan) for the first page is formed on the region P. When the region P having the electrostatic latent image formed thereon reaches a position facing the developing roller 25 of the cyan developing cartridge 15C with the movement of the photosensitive belt 31, the developing roller 25 of the cyan developing cartridge 15C is brought into contact with the region P of the photosensitive belt 31 by the not-shown developing cartridge contact/separation mechanism, so that the electrostatic latent image on the region P is developed. As a result, a cyan toner image for the first page is formed on the region P of the photosensitive belt 31.

When the photosensitive belt 31 is then further moved so that the region P of the photosensitive belt 31 faces the intermediate transfer belt 35, the cyan toner image formed on the region P is transferred onto the region R of the intermediate transfer belt 35 corresponding to the region P of the photosensitive belt 31 so as to be superposed on the magenta toner image which has been already transferred on the region R of the intermediate transfer belt 35.

While the cyan toner image on the region P is transferred onto the region R of the intermediate transfer belt 35, a laser beam emitted from the scanner unit 14 is applied onto the region Q of the photosensitive belt 31 at a point irradiated with the laser beam in order to successively form a cyan toner image based on image data of C (cyan) for the second page. As a result, an electrostatic latent image based on the image data of C (cyan) for the second page is formed on the region Q. When the region Q having the electrostatic latent image formed thereon reaches a position facing the developing roller 25 of the cyan developing cartridge 15C with the movement of the photosensitive belt 31, the developing roller 25 of the cyan developing cartridge 15C being still in contact with the photosensitive belt 31 from the region P by the not-shown developing cartridge contact/separation mechanism develops the electrostatic latent image on the region Q of the photosensitive belt 31. As a result, a cyan toner image for the second page is formed on the region Q of the photosensitive belt 31.

When the electrostatic latent image on the region Q of the photosensitive belt 31 is entirely developed, the developing roller 25 of the cyan developing cartridge 15C is separated from the photosensitive belt 31 by the developing cartridge contact/separation mechanism.

When the photosensitive belt 31 is then further moved so that the region Q of the photosensitive belt 31 faces the intermediate transfer belt 35, the cyan toner image formed on the region Q is transferred onto the region S of the intermediate transfer belt 35 corresponding to the region Q of the photosensitive belt 31 so as to be superposed on the yellow and magenta toner images which have been already transferred on the region S of the intermediate transfer belt 35.

While the cyan toner image on the region Q is transferred onto the region S of the intermediate transfer belt 35, a laser beam emitted from the scanner unit 14 is applied onto the region P of the photosensitive belt 31 at a point irradiated with the laser beam in order to successively form a black toner image based on image data of K (black) for the first page. As a result, an electrostatic latent image based on the image data of K (black) for the first page is formed on the region P. When the region P having the electrostatic latent image formed thereon reaches a position facing the developing roller 25 of the black developing cartridge 15K with the movement of the photosensitive belt 31, the developing roller 25 of the black developing cartridge 15K is brought into contact with the region P of the photosensitive belt 31 by the not-shown developing cartridge contact/separation mechanism, so that the electrostatic latent image on the region P is developed. As a result, a black toner image for the first page is formed on the region P of the photosensitive belt 31.

When the photosensitive belt 31 is then further moved so that the region P of the photosensitive belt 31 faces the intermediate transfer belt 35, the black toner image formed on the region P is transferred onto the region R of the intermediate transfer belt 35 corresponding to the region P of the photosensitive belt 31 so as to be superposed on the magenta and cyan toner images which have been already transferred on the region P of the intermediate transfer belt 35.

While the black toner image on the region P is transferred onto the region R of the intermediate transfer belt 35, no laser beam emitted from the scanner unit 14 is applied to the region Q of the photosensitive belt 31 even in the case where the region Q of the photosensitive belt 31 reaches a point irradiated with the laser beam because image data of K (black) for the second page is dummy data 61 having the pixel value set to "0". As a result, an electrostatic latent image based on image data of K (black) for the second page is not formed on the region Q of the photosensitive belt 31. For this reason, even in the case where the region Q reaches a position facing the developing roller 25 of the black developing cartridge 15K with the movement of the photosensitive belt 31 so that the developing roller 25 of the black developing cartridge 15K being still in contact with the photosensitive belt 31 from the region P is brought into contact with the region Q of the photosensitive belt 31 by the not-shown developing cartridge contact/separation mechanism, there is no electrostatic latent image developed on the region Q, so that there is no black toner image formed on the region Q. Even in the case where the photosensitive belt 31 is then further moved so that the region Q of the photosensitive belt 31 faces the intermediate transfer belt 35, there is no black toner image transferred onto the region S of the intermediate transfer belt 35 corresponding to the region Q of the photosensitive belt 31 because no black toner image is formed on the region Q. Accordingly, there is no black toner image superposed on the yellow, magenta and cyan toner images on the region S.

When the multi-color toner image obtained by superposition of toner images of the three colors of M (magenta), C (cyan) and K (black) based on image data for printing the first page on the region P and the multi-color toner image obtained by superposition of toner images of the three colors of Y (yellow), M (magenta) and C (cyan) based on image data for printing the second page on the region Q, that is, two-pages' multi-color toner images are formed on the intermediate transfer belt 35 in this manner, these toner images are continuously transferred onto two A4-size sheets of paper 3 by the transfer roller 18 while the intermediate transfer belt 35 makes one rotation. Thus, this processing is completed.

After simultaneous printing is performed in this manner, the printing selection program is restarted while the third and fourth pages are regarded as the first and second pages respectively, so that selection of simultaneous printing or ordinary printing is performed again.

As described above, according to the aforementioned processing, dummy data 61 are generated by the dummy data generating program on the basis of colors required for the first multi-color toner image formed on the intermediate transfer belt 35, that is, the variety of colors of image data for printing the first page, and colors required for the second multi-color toner image, that is, the variety of colors of image data for printing the second page. Accordingly, the multi-color toner images can be simultaneously printed on continuously fed two A4-size sheets of paper 3 by the simultaneous printing program. Accordingly, the first sheet of paper 3 and the second sheet of paper 3 can be processed as a set in order from the beginning of one printing job, so that printing on sheets of paper 3 at the beginning of the printing job can be started speedily.

When the dummy data 61 are generated by the dummy data generating program, image data for simultaneous printing of the first and second pages can be made coincident with each other even in the case where image data for printing the first and second pages are different from each other. Accordingly, speedy simultaneous printing can be performed not only in the case where monochrome images and color images are combined so that the first page has a monochrome image, the second image has a color image, the third page has a color image and the fourth image has a monochrome image, but also in the case where only color images are combined so that the first and second pages have color images respectively.

Furthermore, the dummy data generating program compares the variety of colors of image data for printing the first page with the variety of colors of image data for printing the second page and generates dummy data 61 as follows in order that the varieties of colors of image data for simultaneous printing of the first and second pages coincide with each other. When there is a color not contained in the variety of colors of image data for printing the first page but contained in the variety of colors of image data for printing the second page, image data of the color is generated as dummy data 61 for the first page so that the dummy data 61 for the first page and the variety of colors of image data for printing the first page form the image data for the first page. When there is a color not contained in the variety of colors of image data for printing the second page but contained in the variety of colors of image data for printing the first page, image data of the color is generated as dummy data 61 for the second page so that the dummy data 61 for the second page and the variety of colors of image data for printing the second page form the image data for the second page. Accordingly, the image data for simultaneous printing of the first and second pages after addition of the dummy data 61 can be made coincident with each other. Accordingly, even in the case where the first page has a color image and the second page has a color image different in variety of colors from the color image of the first page, the varieties of colors of image data for the first page and the second page can be made coincident with each other so that efficient simultaneous printing can be achieved.

In the aforementioned processing, the number of transferring operations in simultaneous printing is compared with the number of transferring operations in ordinary printing. When the number of transferring operations in simultaneous printing is smaller than the number of transferring operations in ordinary printing, the dummy data 61 are generated so that simultaneous printing is performed. Accordingly, simultaneous printing is performed only when the number of transferring operations can be reduced and ordinary printing is performed when the number of transferring operations cannot be reduced, so that simplification of control can be attained while speedy printing is secured.

Furthermore, in the aforementioned processing, the printing selection program uniformly compares the number of transferring operations in simultaneous printing with the number of transferring operations in ordinary printing by a simple arithmetic operation. Accordingly, speedy processing can be attained. Because the number of transferring operations in simultaneous printing is smaller than the number of transferring operations in ordinary printing by the number of duplicate colors between the varieties of colors of image data for printing the first and second pages, speedy simultaneous printing can be achieved according to the number of duplicate colors.

Furthermore, in the aforementioned processing, when the number of transferring operations in simultaneous printing is equal to the number of transferring operations in ordinary printing, simultaneous printing is not performed on the first and second sheets of paper 3 but ordinary printing is performed on the first sheet of paper 3. Accordingly, simplification of control can be attained. When ordinary printing is performed, simultaneous printing can be performed on the second and third sheets of paper while image data for printing the second page is regarded as image data for printing the first page and next image data for printing the third page is regarded as image data for printing the second page. Accordingly, simultaneous printing can be performed efficiently, so that speedy simultaneous printing can be achieved.

In the aforementioned processing, when the intermediate transfer belt 35 is idly rotated by the ordinary printing program before the second multi-color toner image is carried on the intermediate transfer belt 35 after the first multi-color toner image is transferred onto a sheet of paper 3, the printing selection program adds the number of idle rotations of the intermediate transfer belt 35 to the number of transferring operations in ordinary printing. Accordingly, the number of transferring operations in simultaneous printing can be more accurately compared with the total number of transferring operations in ordinary printing. Accordingly, more efficient printing can be achieved.

Although the embodiment of the invention has been described, the invention can be also carried out in other embodiments. For example, in the embodiment, the length of the photosensitive belt 31 is set so that two-pages' A4-size mono-color toner images according to each color can be carried on the photosensitive belt 31 at one time. For example, the photosensitive belt 31 maybe smaller than a size of two A4-size pages. Incidentally, in this case, it is necessary to use a seamless photosensitive belt.

Although the embodiment has been described on the case where the invention is applied to the color laser printer 1 having the intermediate transfer belt 35 as the intermediate transfer body, the invention can be also applied to a color laser printer having an intermediate transfer drum as the intermediate transfer body.

The invention is not limited in the combination of image data according to each color as described in the embodiment. The invention can be also applied to other combinations than the combination of image data according to each color as described in the embodiment.

As described above, according to the invention, speedy simultaneous printing can be achieved.

According to the invention, even in the case where the variety of colors of image data required according to respective colors for forming the first multi-color image are different from the variety of colors of image data required according to respective colors for forming the second multi-color image, the two varieties of colors of image data required according to respective colors can be made coincident with each other so that efficient simultaneous printing can be achieved.

According to the invention, even in the case where the first multi-color image is different in variety of colors from the second multi-color image, the two varieties of colors of image data required according to respective colors for the first and second multi-color images can be made coincident with each other so that efficient simultaneous printing can be achieved.

According to the invention, simplification of control can be attained while speedy printing is secured.

According to the invention, the number of transferring operations in simultaneous printing can be uniformly compared with the number of transferring operations in ordinary printing by a simple arithmetic operation. Accordingly, speedy simultaneous printing can be achieved.

What is claimed is:

1. An image forming apparatus, comprising:

an electrostatic latent image carrier capable of carrying an electrostatic latent image for at least two pages;

an electrostatic latent image-forming unit that forms the electrostatic latent image on the electrostatic latent image carrier according to image data of each color;

a plurality of developing units that develop the electrostatic latent image on the electrostatic latent image carrier by a developer of each color to form a mono-color developer image according to each color;

an intermediate transfer body onto which mono-color developer images of respective colors formed by the plurality of developing units are transferred successively so as to be superposed on one another to form a multi-color developer image;

a transfer unit that transfers the multi-color developer image formed on the intermediate transfer body onto a recording medium; and a simultaneous printing unit configured to form an electrostatic latent image for two pages and a mono-color developer image for two pages continuously on the electrostatic latent image carrier, to transfer the mono-color developer image for two pages successively onto the intermediate transfer body to make the intermediate transfer body carry a multi-color developer image for two pages, and to transfer the multi-color developer image for two pages onto two sheets of recording media by the transfer unit to form two multi-color images including a first multi-color image and a second multi-color image;

wherein the simultaneous printing unit includes a simultaneous printing image data generating unit configured to generate image data of each color for simultaneous printing so that a variety of image data of each color for forming the first multi-color image coincide with a variety of image data of each color for forming the second multi-color image, when a variety of colors required for forming the second multi-color image include some or none of a variety of colors required for forming the first multi-color image.

2. The image forming apparatus according to claim 1, wherein the simultaneous printing image data generating unit generates image data of each color for forming the first multi-color image so that image data of a color not actually contained in the image data of the variety of colors for forming the first multi-color image but actually contained in the image data of the variety of colors for forming the second multi-color image is generated as dummy data in addition to actual image data of the variety of colors required for forming the first multi-color image; and the simultaneous printing image data generating unit generates image data of each color for forming the second multi-color image so that image data of a color not actually contained in the image data of the variety of colors required for forming the second multi-color image but actually contained in the image data of the variety of colors for forming the first multi-color image is generated as dummy data in addition to actual image data of the variety of colors required for forming the second multi-color image.

3. The image forming apparatus according to claims 1, further comprising:

an ordinary printing unit configured to form an electrostatic latent image for one page and a mono-color developer image for one page on the electrostatic latent image carrier, to transfer the mono-color developer image successively onto the intermediate transfer body to make the intermediate transfer body carry a multi-color developer image, and to transfer the multi-color developer image for one page onto one sheet of a recording medium to form a multi-color image; and a comparison unit configured to compare the number of operations of transferring a mono-color developer image from the electrostatic latent image carrier onto the intermediate transfer body in the case where two multi-color images are generated by simultaneous printing, with the number of operations of the transferring in the case where two multi-color images are generated by ordinary printing;

wherein, when the variety of colors required for forming the first multi-color image are different from the variety of colors required for forming the second multi-color image, the simultaneous printing image data generating unit generates image data of each color for simultaneous printing and the simultaneous printing unit performs simultaneous printing if the comparison unit makes a decision that the number of transferring operations in the simultaneous printing is smaller than the number of transferring operations in the ordinary printing.

4. The image forming apparatus according to claim 3, wherein the comparison unit calculates the number of transferring operations in the ordinary printing as the sum of the number of colors required for forming the first multi-color image and the number of colors required for forming the second multi-color image; and the comparison unit calculates the number of transferring operations in the simultaneous printing as a value obtained by subtraction of the number of duplicate colors between the variety of colors required for forming the first multi-color image and the variety of colors required for forming the second multi-color image from the sum of the number of colors required for forming the first multi-color image and the number of colors required for forming the second multi-color image.

5. The image forming apparatus according to claim 3, wherein the ordinary printing unit performs ordinary printing when the comparison unit compares the number of transferring operations in the ordinary printing with the number of transferring operations in the simultaneous printing and makes a decision that the two numbers are equal to each other.

6. The image forming apparatus according to claim 3, wherein the comparison unit adds the number of operations of idly rotating the intermediate transfer body to the number of transferring operations in the ordinary printing when the ordinary printing unit idly rotates the intermediate transfer body before the second multi-color developer image is carried on the intermediate transfer body after the first multi-color developer image is transferred on the recording medium.

7. The image forming apparatus of claim 1, further comprising:

a storage unit configured to store image data of each color for at least two pages;

wherein the simultaneous printing unit includes a simultaneous printing image data generating unit configured to generate image data of each color for simultaneous printing on the basis of a variety of colors required for forming the first multi-color image and a variety of colors required for forming the second multi-color image.

8. The image forming apparatus of claim 1, further comprising:

a storage unit configured to store image data of each color for at least two pages;

wherein the simultaneous printing unit generates additional data to be added to the image data of each color stored in the storage unit on the basis of a variety of colors required for forming the first multi-color image and a variety of colors required for forming the second multi-color image;

the simultaneous printing unit generates image data of each color for simultaneous printing by adding the additional data to the image data of each color stored in the storage unit; and the electrostatic latent image-forming unit forms the electrostatic latent image on the electrostatic latent image carrier according to the image data of each color for simultaneous printing.

9. An image forming method, comprising:

forming an electrostatic latent image for two pages on an electrostatic latent image carrier;

developing the electrostatic latent image for two pages on the electrostatic latent image carrier by a developer of each color to form a mono-color developer image for two pages of each color;

transferring the mono-color developer image for two pages of respective color repeatedly on an intermediate transfer body to form a multi-color developer image for two pages on the intermediate transfer body;

transferring the multi-color developer image for two pages formed on the intermediate transfer body onto two sheets of recording media to form two multi-color images including a first multi-color image and a second multi-color image;

wherein the forming step includes:

generating image data of each color for two pages for simultaneous printing so that a variety of image data of each color for forming the first multi-color image coincide with a variety of image data of each color for forming the second multi-color image, when a variety of colors required for forming the second multi-color image include some or none of a variety of colors required for forming the first multi-color image; and forming the electrostatic latent image for two pages on an electrostatic latent image carrier on the basis of the image data of each color for two pages for simultaneous printing.

* * * * *